US006096683A

United States Patent [19]

Amano et al.

[11] Patent Number: 6,096,683

[45] Date of Patent: Aug. 1, 2000

[54] REVERSIBLE THERMOSENSITIVE RECORDING MEDIUM AND METHOD FOR PRODUCING THE MEDIUM

[75] Inventors: Tetsuya Amano, Numazu; Kazumi Suzuki, Shimiqu-machi; Atsushi Kutami, Numazu; Yoshihiko Hotta, Mishima; Kunichika Moroboshi, Namazu, all of Japan

[73] Assignee: Ricoh Company, Ltd., Tokyo, Japan

[21] Appl. No.: 08/957,665

[22] Filed: Oct. 24, 1997

[30] Foreign Application Priority Data

Oct. 24, 1996 [JP] Japan ..... 8-299269
Jun. 10, 1997 [JP] Japan ..... 9-166688

[51] Int. Cl.[7] ..... B41M 5/34

[52] U.S. Cl. ..... 503/208; 503/201

[58] Field of Search ..... 503/200, 201, 503/208, 226; 427/150–152

[56] References Cited

FOREIGN PATENT DOCUMENTS 63-39378 2/1988 Japan .

*Primary Examiner*—Bruce H. Hess
*Attorney, Agent, or Firm*—Cooper & Dunham LLC

[57] ABSTRACT

A reversible thermosensitive recording medium having a supporting substrate and a reversible thermosensitive recording layer formed on the supporting substrate, being capable of reversibly varying color density depending upon temperature with improved durability, is provided. The recording medium has the rates of changes in recording sensitivity and in erasure sensitivity, which are caused by the immersion in an artificial perspiration liquid, of 50% or less and 80% or more, respectively, and an average maximum particle size of organic materials of 2.5 microns at most.

4 Claims, 3 Drawing Sheets

REVERSIBLE THERMOSENSITIVE RECORDING MEDIUM AND METHOD FOR PRODUCING THE MEDIUM

BACKGROUND OF THE INVENTION

1. Field of the Invention

The present invention relates generally to a reversible recording medium, and more particularly to a reversible thermosensitive recording medium capable of repeatedly forming and erasing images by utilizing a reversible change in the transparency or color of a thermosensitive layer therein by a temperature change.

2. Background of the Invention

A variety of information recording media have been developed to comply with the demands created by the expanding volume of information. A reversible thermosensitive recording medium has been attracting much attention recently for its capability of forming and erasing images repeatedly on demand, and at relatively low cost without complicated developing steps.

Reversible thermal recording media are known to be capable of carrying out forming and erasing images by reversibly changing optical properties between two states, a white opaque state (image formed state) and a transparent state (erased state), depending on temperature.

For example, recording materials which comprise low molecular weight organic materials such as higher fatty acids dispersed in matrix resins such as vinyl chloride-vinyl acetate copolymers and have relatively low glass transition temperatures, ranging from approximately 50° C. to equal or less than 80° C. (Japanese Laid-Open Patent Applications No. 54-119377 and 55-154198).

However, these recording materials remain transparent in temperature ranges as narrow as from 2° to 4° C., which is unsatisfactory for image recordings using reversible recording materials.

In view of the above problem, the present inventors proposed recording materials in Japanese Laid-Open Patent Application Nos. 63-39378, 2-1363, 3-2089, and 5-294066, which broaden the above-mentioned temperature range, by using different kinds of low molecular weight organic materials or a combination thereof as the recording materials. While it is not possible with this technique to completely erase images with a thermal print head, the images can be erased by heating for a relatively long heating period with a heating roller or a hot plate.

To improve the image erasure characteristics, the present inventors further proposed a recording material in Japanese Laid-Open Patent Application No. 7-820491, in which rates of change in: (1) heating temperature for the initiation of transparentization; (2) transparency; and/or (3) film thickness, are specified for the recording material. By use of this recording material, the erasure characteristics are improved.

Japanese Patent Publication No. 2597268 discloses a low molecular weight organic material in a thermosensitive recording medium, including a mixture of at least one long chain alkyl compound having a melting point of from 50° to 100° C. having at least one saturated fatty acid bisamide. It has a melting point of 110° C. or higher with a mixing ratio of from 98:2 to 80:20, to broaden the range of the "transparentization" temperature and to improve the erasure characteristics with a thermal print head. However, the recording medium is difficult to form in an even layer because of difficulties caused by: (1) the relatively poor solubility of the bisamides in solvent, such as tetrahydrofuran or the like; and (2) an insufficient dispersion of the particles of this organic material into a matrix resin. The above-mentioned recording medium was found quite difficult to change into the white opaque state (i.e., image formed state) with a resulting poor image contrast, thereby being unsuited for practical use.

A reversible recording medium is generally used and/or stored under various ambient conditions. When the medium is used especially in a rewritable recording card such as, for example, a point-of-sales card, the conditions of card storage and handling by each individual can be quite varied. Therefore, it is important that the recording material used in a reversible recording medium have durability under diversified storage conditions.

In addition, once a recording medium is stored at its recorded opaque white state (at erased transparent state) for a period of time as long as, for example, several months, a change in recording or erasure characteristics results. Namely, when a recording or erasure is made with a thermal printhead or a hot stamp after a prolonged storage, a decrease in image contrast is found in recorded images (i.e., in the reflective optical density of the images at the recorded white opaque state), or in erased images (i.e., in the reflective optical density at the erased transparent state). The display quality of images of the recording medium may thus be deteriorated as a result of the prolonged storage.

SUMMARY OF THE INVENTION

It is therefore an object of the present invention to provide a reversible thermosensitive recording material which overcomes the above-noted difficulties. A further object of the present invention is to provide a reversible thermosensitive recording material which does not lose its ability to form or erase images with a thermal printhead or a hot stamp, even after a prolonged storage of the recording medium.

These and other objects of the present invention are accomplished by providing a reversible thermosensitive recording medium, having a supporting substrate and a reversible thermosensitive recording layer disposed on the supporting substrate and including, as main ingredients, a matrix resin and a low molecular weight organic material dispersed in the matrix resin, in which the color of the reversible thermosensitive recording layer reversibly changes depending on the temperature thereof. The reversible thermosensitive recording medium has rates of change in recording sensitivity and in erasure sensitivity (caused by the immersion in a salt and ammonia bath for a predetermined period of time) which are 50% or less and 80% or more, respectively, and which has an average maximum particle size of 2.5 microns or less.

According to an alternative embodiment, the low molecular weight organic material is a mixture of at least one low melting point, low molecular weight organic compound with at least one high melting point, low molecular weight organic compound, and has no carboxyl group in the structure of the organic compounds. In addition, the melting point of the low melting point, low molecular weight organic compound is preferably between 40° and 100° C., and the melting point of the high melting point, low molecular weight organic compound is preferably between 100° and 200° C. The difference in melting point between the low and the high melting points should preferably be at least 20° C.

In another embodiment, the reversible thermosensitive recording medium has a level difference and a rate of change in level difference, which are caused by heat and pressure, of 40% or less and 70% or less, respectively.

In yet another embodiment, a method of forming and erasing an image on the reversible thermosensitive recording medium is provided. The method comprises heating the thermosensitive recording layer to a first temperature to form a first color image, and to a second temperature higher than the first temperature and then cooling the layer to form a second color image in the thermosensitive recording layer. Heating to the first temperature is carried out with a thermal printhead, and heating to the second temperature may be with including a thermal printhead, a ceramic heater, a hot stamp, a heat roller or a heat block.

BRIEF DESCRIPTION OF THE DRAWINGS

Preferred embodiments of the invention are described hereinbelow with reference to the drawings wherein.

DESCRIPTION OF THE PREFERRED EMBODIMENTS

Figure 1:
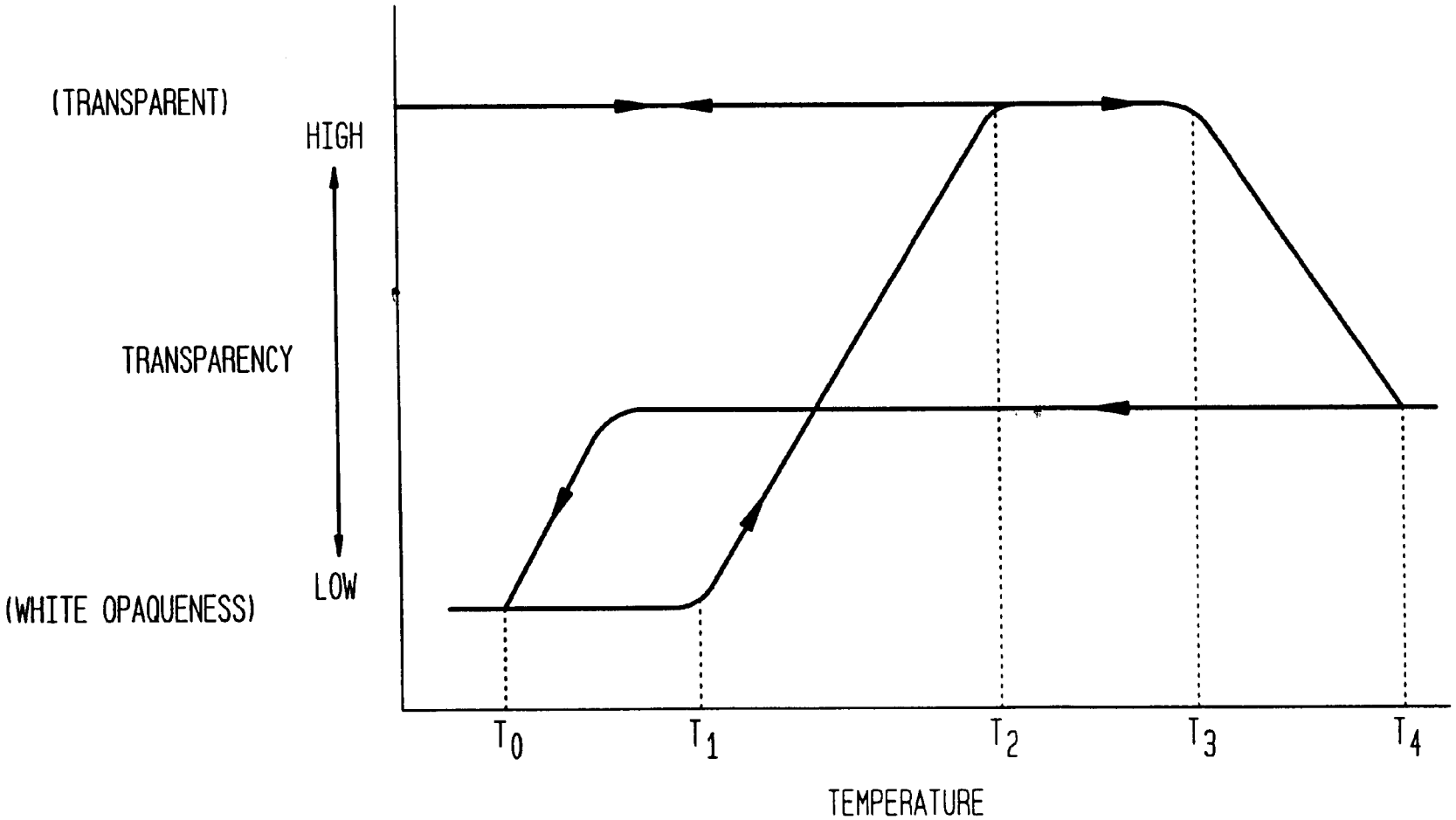
FIG. 1 is a diagram showing the temperature dependency of transparency of a thermosensitive recording medium according to the present invention.
Figure 2A:
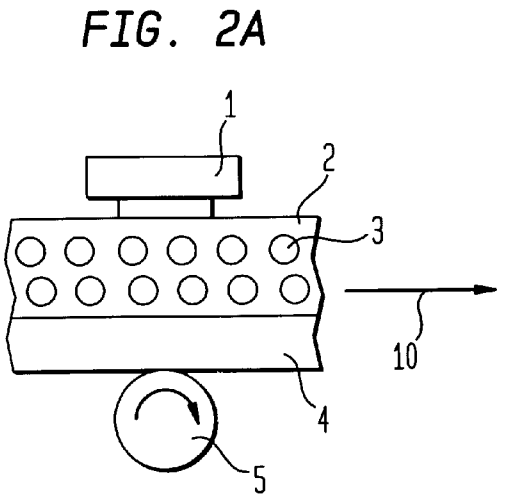
FIGS. 2(*a*) through 2(*d*) show the influence of heat upon a thermosensitive recording medium according to the present invention.
Figure 2B:
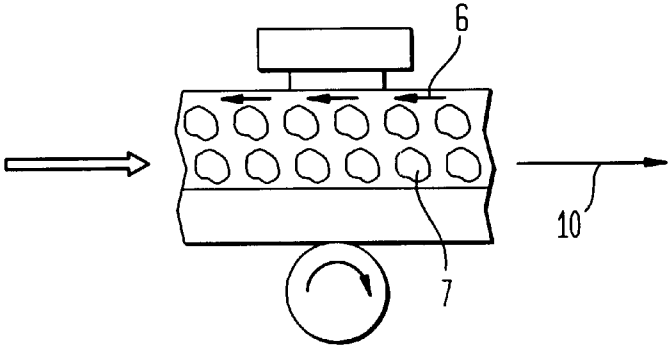
Figure 2C:
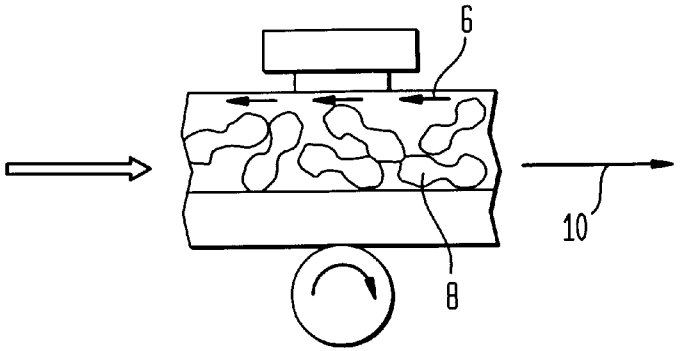
Figure 2D:
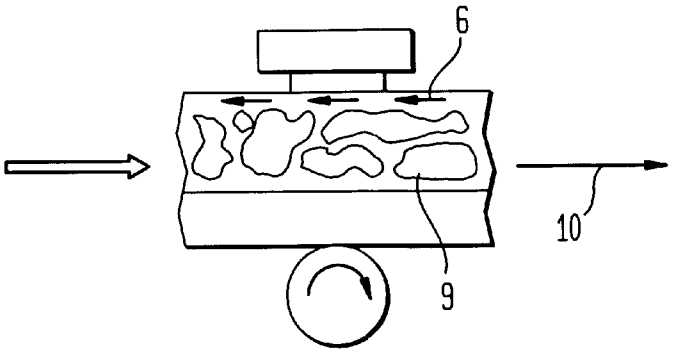

In the detailed description which follows, specific embodiments of the invention particularly useful in the image recording applications are described. It is understood, however, that the invention is not limited to these embodiments. For example, it is appreciated that the recording media and methods of the invention are adaptable to any form of reversible recording media. Other embodiments will be apparent to those skilled in the art upon reading the following description.

A reversible thermosensitive recording medium of the present invention comprises a layer of thermosensitive recording material which is able to reversibly exhibit a change in transparency or in color, depending on the temperature of the recording material.

Although this change may be broadly divided into one in color and the other in shape, attention will be focused primarily on the former in the present invention. The change in color includes one in light transmittance, reflectivity, an absorption wavelength, or a scattering rate, and in combination thereof, which may generally be utilized for displaying images.

More specifically, the recording layer of the present invention is utilized such that the recording layer turns to a first color state when heated at a first temperature higher than an ambient temperature, and then to a second color state when heated at a second temperature higher than the first temperature and cooled subsequently.

Illustrative examples of the above-mentioned recording material include ones which become: (1) transparent at a first temperature and then white opaque at a second temperature (Japanese Laid-Open Patent Application No. 55-154198); (2) colored at a second temperature and colorless at a first temperature (Japanese Laid-Open Patent Application Nos. 4-224996, 4-247985, and 4-267190); (3) white opaque at a first temperature and transparent at a second temperature (Japanese Laid-Open Patent Application No. 3-169590); and (4) colored in, for example, black, red, or blue at a first temperature and colorless at a second temperature (Japanese Laid-Open Patent Application Nos. 2-15 188293 and 2-188294).

Suitable materials for use in the recording layer include: (1) materials which reversibly changes the optical transmittance, composing low molecular weight organic materials such as higher alcohols or higher fatty acids which are dispersed in a matrix resin; and (2) materials which reversibly change color, composing leuco dyes having an improved reversibility.

The above-mentioned recording layer is described in more detail hereinafter, which includes low molecular weight organic materials dispersed in a matrix resin, and reversibly changes its transmittance.

The mechanism of the change of the reversible thermosensitive recording material between white opaqueness and transparency in accordance to the present invention is considered as follows.

The mechanism is believed to be that: (1) in the transparent state, particles of the low molecular weight organic material dispersed in the resin matrix are in close contact with a matrix resin without any space therebetween and without any space within the particles, so that incident light from one side can be transmitted out of the other side without appreciable scattering, thereby being seen as transparent; and (2) in white opaque state, the particles of the low molecular weight organic material are composed of numerous minute crystals and there are formed interstices at the interface between the minute crystals and the matrix resin, so that incident light from one side is reflected or scattered on the interfaces, thereby being seen to be opaque white.

Referring to FIG. 1, showing the change in transparency by heating, a thermosensitive layer comprising a matrix resin and a low molecular weight organic material dispersed in the matrix resin is at a white opaque state at an ambient temperature $T_0$ or below.

Upon being heated, the thermosensitive layer at a temperature $T_1$ gradually becomes transparent and becomes completely transparent in a temperature range from $T_2$ to T3. When this layer is cooled down to ambient temperature below $T_0$, the layer remains transparent.

The above phenomenon may be explained as follows. As the temperature is increased to $T_1$, the resin begins softening. As the softening proceeds, the resin fills the space between the resin and the particles of the low molecular weight organic material and between adjacent particles, so that the transparency increases. At a temperature ranging from $T_2$ to $T_3$ the low molecular weight organic material partly melts so that the remaining space is filled therewith, whereby the layer becomes transparent. When the layer is cooled as mentioned above, the low molecular weight organic material is crystallized at a relatively high temperature because of the presence of seed crystals. In this case, since the resin still remains in a softened state, the resin can follow the volume change caused by the crystallization of the low molecular weight organic material, so that no space is formed, i.e., the layer is maintained transparent upon being cooled.

By contrast, when heated to a temperature $T_4$ or higher, the layer becomes translucent between the maximum transparency and the opaqueness. When the temperature is subsequently lowered, the layer returns to the original white opaque state rather than the transparent state.

This may be explained as follows. At a temperature of $T_4$ or higher, the low molecular weight material completely melted. When the temperature is then lowered, the low molecular weight material becomes super-cooled and crystallizes at a temperature a little higher than $T_0$. In this case, the matrix resin which already started to solidify and which is no longer in the softened state, is therefore not able to follow the volume change caused by the crystallization of the low molecular weight organic material, resulting in the formation of space and thereby the opaque state, as above-mentioned. The transparency versus temperature curve in FIG. 1 illustrates a typical example, but the transparency characteristics will vary when the materials used are changed.

The melting temperature of the low molecular weight organic materials and the softening temperature of the matrix resin play an important role in the change of transparency. To improve the durability of the reversible recording medium without deteriorating the aforementioned initial display characteristics, such as contrast and visibility for the recording medium even after a prolonged storage, it is necessary to prevent adverse changes in the melting temperature of the low molecular weight organic materials and in the softening temperature of the matrix resin.

The present inventors have investigated a mechanism by which a decrease in the image recording or erasure characteristics of a recording medium is caused once the recording medium is stored at its recorded opaque white state or at erased transparent state for a period of time of, for example, several months.

As a result, the above-mentioned reduction in the image recording characteristics are observed for both cases of heating the recording medium with: (1) a thermal printhead, which takes a relatively short time for heating such as several milliseconds; and (2) with a hot stamp or the like which takes longer, such as several seconds.

In addition, from the results of the present investigation into the relationship between the recording energy and reflection optical density using both a thermal printhead and a hot stamp, it has been found that an energy and a temperature, which is required for the formation of a saturated white opaque state after a prolonged storage (hereinafter referred to, respectively, as 'a deferred saturation white opaque energy' and 'a deferred saturation white opaque temperature'), are considerably increased from corresponding energy and temperature values prior to the prolonged storage (hereinafter referred to, respectively, as 'an initial saturation white opaque energy' and 'an initial saturation white opaque temperature'). This indicates a considerable decrease in the thermal sensitivity of the recording medium, thereby occasionally resulting in even a failure in achieving the saturated white opaque state.

The present inventors have further investigated a mechanism by which the above-mentioned increase in the saturation white opaque energy is caused by the prolonged storage. As a result, it has been found the increase is observed more frequently when the recording medium was stored for a relatively long period of time in an environment with a high concentration of a basic substance such as, especially, ammonia.

Following the above findings, thermal properties and molecular structure of the recording medium after the storage are investigated by differential scanning calorimetry (DSC) and infrared (IR) spectra. The DSC results shows that a melting temperature of the low molecular weight organic material is considerably increased after the prolonged storage, wherein, in the case of the aforementioned two-component organic material, the above melting temperature is defined by that of the low molecular weight organic material with a higher melting point. Also, the IR results on the low molecular weight organic material following the prolonged storage shows that an absorption band attributed to carboxyl is diminished and one attributed to an ionic bond emerges.

From these results, it is considered that the above-mentioned increase in the melting temperature of the low molecular weight organic materials is caused by a reaction between a carboxyl group in the organic materials and ammonia as a basic material to form carboxylic ammonium salt, thereby resulting in the increase in the melting temperature.

Also, from these results it is deduced that the decrease in the recording sensitivity for the medium which is shown as the increase in the aforementioned saturation white opaque energy or saturation white opaque temperature, is caused by the increase in the melting temperature of the low molecular weight organic material after the prolonged storage.

In other words, because of the increase in the melting temperature of the low molecular weight organic material, a higher temperature is required to completely melt the recording material so as to transform from its transparent state to white opaque state, that is, the organic materials after the storage cannot melt at the temperature at which the materials can be completely melted initially or prior to the storage, resulting in a reduction in the recorded image density compared to that prior to the storage.

The present inventors have also investigated a mechanism by which a reduction in the image erasure characteristics of a recording medium is caused once the recording medium is stored at its recorded opaque white state (at erased transparent state) for a period of time such as, for example, several months.

In a similar manner to the aforementioned image recording case, the reduction in the image erasure characteristics were found for both cases of heating the recording medium, one with a thermal printhead which takes a relatively short time such as several milliseconds, and the other with a hot stamp which takes longer such as several seconds.

In addition, for the hot stamp heating, further investigations about the temperature and the temperature range at which the change from the white opaque state to transparent state demonstrate that each of the lowest and highest temperatures of the range increased considerably after the storage, and that the temperature range also shifts toward higher temperature to a extent that the 'deferred' (or post-storage) range results in little or no overlap with the initial (or pre-storage) range of the temperature.

The present inventors have further investigated a mechanism by which the above-mentioned decrease in the image erasure characteristics is caused by the prolonged storage. As a result, the decrease was found more frequently when the recording medium was stored for a relatively long period of time in an environment with a high concentration of basic materials such as, especially, ammonia.

Following the above findings, thermal properties and molecular structure of the recording medium after the storage are investigated by differential scanning calorimetry (DSC) and infrared (IR) spectra, respectively. The DSC results shows that a melting temperature of the low molecular weight organic material is considerably increased after the prolonged storage, wherein, in the case of the aforementioned two-component organic material, the melting temperature is specified by that of the low molecular weight organic material with a higher melting point. Also, the IR results on the low molecular weight organic material following the prolonged storage shows that an absorption peak attributed to a carboxyl group is diminished and one attributed to an O—N ionic bond emerges.

It is thus considered from these results that the above-mentioned increase in the melting temperature of the low molecular weight organic materials is caused by a reaction between a carboxyl group in the organic materials and ammonia as an basic substance to form a carboxylic ammonium salt, thereby resulting in the increase in the melting temperature.

A decrease in the erasure sensitivity for the medium, such as shown as the aforementioned increase in the temperature and temperature range at which the change from the white opaque state to transparent state could be achieved because of the increase in the melting temperature of the low molecular weight organic material, a higher temperature is required to change the recording material to a half-melted state. That is, the organic materials following the storage cannot be half-melted at the temperature at which the materials can be half-melted initially or prior to the storage, thereby resulting in a reduction in the image erasure density following to the storage compared to that prior to the storage. For the aforementioned two-component organic material, the above-mentioned melting temperature is defined by a higher melting temperature of the low molecular weight organic material.

The present inventors have found that the object of the present invention for improving the recording and erasure characteristics of the reversible thermosensitive recording medium can be achieved by maintaining: (1) the rates of changes in recording sensitivity and in erasure sensitivity to be 50% or less and 80% or greater, respectively; and (2) the average of the particle size in the thermosensitive layer is at most 5 microns.

The above-mentioned rate of change in recording sensitivity achieved in a salt bath is hereinafter referred to as 'rate of change in recording sensitivity', and is represented by the magnitude of the change in the media sensitivity for recording images (i.e., change to a white opaque state), which is caused in a recording medium at an erased (transparent) state by being exposed to a basic ambience for a relatively long period of time compared to the initial sensitivity of the recording medium.

Accordingly, the smaller the rate of the change, the less the decrease in the recording sensitivity. Namely, the smaller the rate of the change, the less the variation of the recorded image density caused by the above exposure, thereby indicating better stability of the image contrast.

To achieve the present object of the invention, the rate of the change in the recording sensitivity is preferably 50% or less, more preferably 30% or less, and most preferably 20% or less.

The rate of the change in the recording sensitivity is measured according to the following method with a heat gradation tester HG-100 from Toyo-Seiki Seisakusho Co.

The conditions under which the recording sensitivity is measured include a printing time of 2 seconds set in a printing timer of the tester and a printing pressure of 1 $kg/cm^2$ indicated on a pressure gauge. Under the above conditions, a reversible thermosensitive medium in a white opaque state is heated at various temperatures increasing by 5° C. from 50° C., and subsequently cooled to an ambient temperature. The medium thus prepared is then subjected to reflection optical density measurements with a MacBeth RD-914 densitometer.

To deduce characteristic values from the measurements, a reference temperature $T_r$ is obtained such that: (1) at the temperature $T_r$, a saturated white opaque density is achieved; or (2) the difference in reflection optical density between at $T_r$ and $T_r$-5 is 0.05 or less, and the reflection density at $T_r$ is equal to or less than one half of the sum of the maximum transparent reflection density and the minimum white opaque density. An initial white opaque density (ODWI) is then obtained as the white opaque density at the temperature $T_r$.

A suitable salt bath is prepared by dissolving 10 g of sodium chloride, 4 g of carboxylic ammonium, and 2.5 g of disodium phosphate dodecahydrate in distilled water to make one liter of solution (pH about 9.0).

A reversible thermosensitive medium is immersed for 100 hours in the foregoing salt bath prepared as above, and then dried. Subsequently, the resulting thermosensitive medium is subjected to reflection density measurements with a MacBeth RD-914 densitometer in a similar manner as aforementioned, and a white opaque density at the temperature $T_r$ is obtained as a deferred white opaque density (ODWD) value.

In addition, prior to these density measurements, a background density (ODB) is measured as the average of the reflection densities at 10 locations on the recording medium which has previously been rendered most transparent by being heated to an arbitrary temperature using a constant temperature oven.

In these ODB measurements, the recording medium may be measured as it is, when a light reflecting layer such as, for example, an evaporated metal film or of a coloring composition sheet or film is placed on the backside of the recording layer. By contrast, when the medium is transparent without reflecting layer, the measurements may be carried out after placing the recording medium on a black coated plate having a reflection density of 1.90.

Using these values obtained from the measurements, the rate of change in recording sensitivity is given by the following equation:

$$\text{Rate of change in recording sensitivity (\%)}=(|ODWD-ODWI|)/(|ODB-ODWI|)\times 100,$$

wherein

ODWI: Initial white opaque density,

ODWD: Deferred white opaque density, and

ODB: Background density.

The aforementioned rate of change in erasure sensitivity by an artificial perspiration liquid is hereinafter referred to as 'rate of change in erasure sensitivity', and is represented by the magnitude of the change in the media sensitivity for erasing images (i.e., change to a transparent state), which is caused in a recording medium in an image formed (white opaque) state by being exposed to a basic environment for a relatively long period of time, compared to an initial erasure sensitivity of the recording medium.

Accordingly, it is indicated that the larger the rate of the change, the less the decrease in the erasure sensitivity. Namely, the larger the rate of the change, the less the variation of the erased image density caused by the above-mentioned contact, thereby indicating better stability of the image contrast.

To achieve the present object in the invention, the rate of the change in the erasure sensitivity is preferably 80% or larger, more preferably 85% or larger, and most preferably 90% or larger.

The rate of the change in the erasure sensitivity is measured in a manner similar to the above-mentioned recording sensitivity measurements.

Namely, the erasure sensitivity measurements are carried out with the heat gradation tester HG-100 from Toyo-Seiki Seisakusho Co, under conditions which include a printing time of 2 seconds set in the printing timer of the tester and a printing pressure of 1 kg/cm$^2$ indicated on a pressure gauge. Under the above conditions, a reversible thermosensitive medium in a white opaque state is heated at arbitrary temperatures, cooled to an ambient temperature, and subsequently subjected to reflection density measurements with a MacBeth RD-914 densitometer.

To deduce characteristic values from the measurements, another reference temperature $T_m$ is obtained as the median of the lowest and the highest of the erasure temperature range at which a reflection density higher than ODB (i.e., −0.1) is achieved. An initial erasure or transparent density (ODTI) is then obtained as the erasure density at the temperature $T_m$.

A reversible thermosensitive medium is immersed for 100 hours in the above-mentioned artificial perspiration liquid, and then dried. The thus prepared medium is subsequently subjected to reflection density measurements with a MacBeth RD-914 densitometer, and a reflection density at the temperature $T_m$ is obtained as a deferred erasure density (ODTD)

Using these values obtained from the present measurements, the rate of change in erasure sensitivity is given by the following equation:

$$\text{Rate of change in recording sensitivity (\%)}=(|ODWD-ODWI|)/(|ODTI-ODWI|)\times 100,$$

wherein

ODTI: Initial erasure density,

ODTD: Deferred erasure density, and

ODWI: Initial white opaque density.

A value of the average maximum particle size is now defined as follows in the present invention.

The average maximum particle size is a quantity which represents the degree of the dispersion of the low molecular weight organic material particles in the matrix resin in the thermosensitive recording layer. The smaller the average maximum particle size, the better the degree of the dispersion, thereby indicating more uniform dispersion of the low molecular weight organic materials in the matrix resin. Namely, the smaller the average maximum particle size, the better initial image recorded and erasure densities, and the better the image contrast. To achieve satisfactory results in these characteristics, the average maximum particle size is preferably 2.5 microns or less, more preferably 2 microns or less.

The average maximum particle size is measured according to the following method with a transmission electron microscope (TEM) H-9000 from Hitachi Co.

A sample thermosensitive recording layer is fixed with an epoxy resin and then sliced with a diamond cutter to form ultra-thin films of the recording layer. With the transmission electron microscope at an acceleration voltage of 300 kV, the films are subsequently observed and five arbitrary locations on the sample layer are photographed in 10,000 magnifications.

The particle number of the low molecular weight organic material which are observed in the area of 10 centimeter square on the photographs prepared as above. Subsequently, particle sizes are obtained for one tenth of the whole particles, which have largest diameters in that area. The average particle diameter (S) is then calculated from the sizes obtained above. The measurements and calculations are repeated similarly for each of the above-mentioned five locations on the sample recording layer to obtain the maximum particle size values S1 through S5. The average maximum particle size ($S_m$) is then calculated by averaging the above obtained maximum particle size values S1 through S5.

When the shape of the particle is observed other than in disk shaped in these measurements, the size is determined by measuring the largest extent of the particle. Also in the measurements, when particles are extremely large at a location to the extent that the total number of particles observed in that location is less than ten, diameters of all particles in the location are measured and the average maximum particle size $S_m$ is calculated in a manner similar to the above-mentioned procedures.

Furthermore, since the above-mentioned reversible thermosensitive recording layer comprises a mixture of at least one low molecular weight organic material having a relatively low melting temperature with and at least one low molecular weight organic material having a relatively high melting temperature, and the low molecular weight organic materials have no free carboxyl group, the decrease in the image recording or the erasure densities after a prolonged storage can be prevented, thereby preserving the image contrast and display quality, due to improved durability.

The carboxyl group is considered to be the major cause for the reaction between the low molecular weight organic material and basic substance, which generally deteriorates the durability of the recording medium. Since no carboxyl group is included in its structure in the present invention, which may cause a reaction to result in change of the structure, the melting point of the low molecular weight organic material is unchanged, thereby resulting in the improved stability of the thermosensitive recording layer.

In the present invention, it is preferred that a low melting point, low molecular weight organic compound and a high melting point, low molecular weight organic compound are used in combination as the low molecular weight material to increase the temperature range in which the recording material is in the transparent state and to improve the erasure characteristics even with a thermal print head.

The difference in melting point between the low and high melting point compounds is preferably at least 20° C., more preferably at least 30° C., most preferably at least 40° C.

The low melting point, low molecular weight organic compound preferably has a melting point of lower than 100° C. but not lower than 40° C., more preferably between 50° C. and 80° C., whereas the high melting point, low molecular weight organic compound preferably has a melting point of between 100° C. and 200° C., more preferably between 110° C. and 180° C.

Examples of low molecular weight organic materials useful for the present invention include, but are not limited to alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; esters of saturated or unsaturated monocarboxylic acids, or saturated or unsaturated dicarboxylic acids, or ester amides and ammonium salts thereof; saturated or unsaturated halogenated fatty acids, and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol.

These materials may be used individually or in combination. These materials have form 10 to 60 carbon atoms, preferably from 10 to 38 carbon atoms, more preferably from 10 to 30 carbon atoms. It is preferred that the low molecular weight organic material has at least one of oxygen, nitrogen, sulfur and halogen in its molecule, such as, for example, —$CONH_2$, —COOR, —NH—, —$NH_2$, —S—, —S—S—, —O—, or halogen.

The low melting point, low molecular weight organic material is preferably a fatty acid ester, an ester of dibasic acid or a dibasic acid ester of polyhydric alcohol, as described hereinafter. These esters may be used individually or in combination.

The fatty acid ester used in the present invention is characterized in that the melting point thereof is lower than the fatty acid (two molecules being in the associated state) having the same carbon number and in that the carbon number thereof is greater than the fatty acids having the same melting point.

Deterioration of images during repeated recording-erasure with a thermal printhead is considered to be caused by a change of a dispersed state of particles of a low molecular weight organic material due to its dissolution in the matrix resin during a heating stage. It is believed that the compatibility of the matrix resin with the low molecular weight organic material is lowered with an increase of the carbon number of the low molecular weight material, so that the deterioration of images by recording-erasure operations decreased. Furthermore, the white opaqueness tends to increase in proportion with an increase of the carbon number.

Therefore, in reversible thermosensitive recording material having the same transparentizing temperature, the use of the fatty acid ester as the low molecular weight organic material to be dispersed in the matrix resin gives an improvement in white opaqueness (i.e., contrast) and durability in repeated use as compared with the case in which a fatty acid is used.

By using such a fatty acid ester in conjunction with a high melting point low molecular weight material, the transparentizing temperature range can be broadened and the erasure characteristics by a thermal printhead can be improved. As a consequence, even when the erasure characteristics change during storage, the recording material still permits the erasure. In addition, because of the characteristics of the recording material itself, which has no carboxyl group in its structure, the durability in repeated use can be improved.

The fatty acid ester suitably used in the present invention may be represented, for example, by the following general formula (I):

$$R_1—COO—R_2 \quad (I)$$

wherein $R_1$ and $R_2$ each represent an alkyl group having at least 10 carbon atoms.

The fatty acid ester preferably has at least 20 carbon atoms, more preferably at least 25 carbon atoms, most preferably at least 30 carbon atoms. As the number of carbon atoms increases, the durability in repeated use is improved. The fatty acid ester preferably has a melting point of at least 40° C., and is used individually or in combination of two or more.

Specific examples of fatty acid esters for use in the present invention include octadecyl palmitate, dococyl palmitate, heptyl stearate, octyl stearate, octadecyl stearate, dococyl stearate, octadecyl behenate, and dococyl behenate.

Dibasic acid esters may be either monoester or diester and may be represented by the following general formula (II), $$ROOC—(CH_2)_n—COOR' \quad (II)$$

wherein R and R' represent, independently from each other, a hydrogen atom or an alkyl group having from 1 to 30 carbon atoms, and n is an integer of from 0 to 40.

In the ester of dibasic acid represented by the formula (II), the alkyl groups R and R' preferably have from 1 to 22 carbon atoms, while n is preferably from 1 to 30, more preferably from 2 to 20. The ester preferably has a melting point of at least 40° C.

Illustrative examples of the ester of a dibasic acid include esters of succinic acid diesters, adipic acid diesters, sabbatic acid diesters, and 1,18-octadecamethylene dicarboxylic acid diesters.

The difatty acid ester of polyhydric alcohol used as the low molecular weight organic material may be a compound represented by the following general formula (III);

$$CH_3(CH_2)_{m-2}COO(CH_2)_nOOC(CH_2)_{m-2}CH_3 \quad (III)$$

wherein n is an integer of from 2 to 40, preferably from 3 to 30, more preferably from 4 to 22 and m is an integer of from 2 to 40, preferably from 3 to 30, more preferably from 4 to 22.

Specific examples of the ester include 1,3-propanediol dialkanate, 1,6-hexanediole dialkanate, 1,10-decanediole dialkanate, and 1,18-octadecanediole dialkanate.

In addition, fatty acid amides are most preferably used in the present invention as the low melting point, low molecular weight compounds and these compounds are used as the thermosensitive recording materials for the first time.

The fatty acid amides are represented by the following general formula:

$$R'CONHROCOR' \quad (IV)$$

wherein R and R' are identical or different and independently one another are each alkyl. The carbon number of the above alkyl are preferably from 1 to 30, more preferably from 1 to 22. Specific examples of the fatty acid amides useful in the present invention include ethanolamine distearate.

Examples of the high melting point, low molecular weight organic compound used in the present invention includes but not limited to ketones having a higher alkyl group, metal salts of fatty acid and sodium salts of α-sulpho fatty acid ester. The organic compound preferably has a melting point of between 100° and 200° C. but not limited to that range of temperature, and is used individually or in combination.

The ketone used in the present invention contains a ketone group and a higher alkyl group as essential constituents and may additionally contain a substituted or non-substituted aromatic or heterocyclic group. The total number of carbon atoms of the ketone is preferably at least 16, more preferably at least 21. The carbazones used in the present invention are derived from the above ketone.

Examples of the ketone and include 3-octadecanone, 7-icosanone, 14-heptacosanone, 18-pentatriacontanone, tetradecanophenone, docosanophenone, docosanonapthothophenone and 2-heneicosanonesemicarbazone.

The metal salts of a fatty acid used in the present invention include but are not limited to cupric stearate (melting point 125° C.), magnesium stearate (135° C.), calcium stearate (150° C.), aluminum monostearate (155° C.), and aluminum distearate (145° C.).

The sodium salts of an α-sulpho fatty acid used in the present invention include but are not limited to α-sulphostearate monosodium salt,

| | |
|---|---|
| $CH_3(CH_2)_{15}CH(SO_3Na)-COOCH_3$, | melting point 180° C. |

In addition, as the high melting point, low molecular weight compounds, saturated fatty acid monoamides and methylolamides are most preferably used in the present invention.

Examples of the saturated fatty acid monoamides amides includes and not limited to:

| | |
|---|---|
| palmitamide $C_{15}H_{31}CONH_2$ | melting point 100° C.; |
| stearamide $C_{17}H_{35}CONH_2$ | melting point 100° C., |
| refined stearamide | melting point 101° C., |
| high grade stearamide | melting point 107° C., |
| beheamide $C_{21}H_{43}CONH_2$ | melting point 100° C., |
| high grade beheamide | melting point 110° C.; |
| and hydroxystearamide $C_{17}H_{34}(OH)CONH_2$ | melting point 110° C. |

Examples of the methylolamides which are amides formed by substituting a hydrogen in the end amino group of the monoamide with a methylol group and used for the first time as the thermosensitive recording materials include but not limited to:

| | |
|---|---|
| methylolstearamide $C_{17}H_{35}CONHCH_2OH$ | melting point 111° C., and |
| methylolbeheamide $C_{21}H_{43}CONHCH_2OH$ | melting point 110° C. |

The mixing ratio between the low melting temperature and high melting point, low molecular weight organic compounds is preferably from 95:5 to 5:95, more preferably from 90:10 to 10:90, most preferably from 80:20 to 20:80.

In addition to the low melting point and high melting point low molecular weight organic compounds above described, other low molecular weight organic compounds which may be used in combination with the above compounds include higher aliphatic acids, such as lauric acid, dodecanic acid, myristic acid, pentadecanic acid, palmitic acid, stearic acid, behenic acid, arachidic acid, and oleic acid.

Examples of low molecular weight organic compounds also include ether or thioether, such as:

$C_{16}H_{33}-O-C_{16}H_{33}$, $C_{16}H_{33}-S-C_{16}H_{33}$, $C_{18}H_{37}-S-C_{18}H_{37}$, $C_{12}H_{25}-S-C_{12}H_{25}$, $C_{19}H_{39}-S-C_{19}H_{39}$, $C_{12}H_{25}-S-S-C_{12}H_{25}$, $O(CH_2CH_2OCOC_{11}H_{23})_2$, $O(CH_2CH_2OCOC_{17}H_{35})_2$, $O(CH_2CH_2OCOC_{11}H_{23})(CH_2CH_2OCOC_{17}H_{35})$, $O(CH_2CH_2OCO(CH_2)_{15}CH(CH_3)CH_2CH_3)_2$

-continued $O(CH_2CH_2OCO(CH_2)_{15}CH(CH_3)CH_2CH_3)(CH_2CH_2OCOC_{12}H_{25})$, $O(CH_2CH_2OCOC_{12}H_{25})_2$, $O(CH_2CH_2OCOC_{18}H_{37})_2$, $O(CH_2CH_2OCO(CH_2)_{15}CH(CH_3)CH_2CH_3)(CH_2CH_2OCOC_{12}H_{25})$, $O(CH_2CH_2OCO(CH_2)_{15}CH(CH_3)CH_2CH_3)(CH_2CH_2OCOC_{18}H_{37})$, $NH(CH_2CH_2OCOC_{18}H_{37})_2$, and $NH(CH_2OCO(CH_2)_{13}CH(CH_3)CH_2CH_3)(CH_2OCO(CH_2)_{13}CH(CH_3)CH_2CH_3)$.

The weight ratio of the low molecular weight organic material to matrix polymer resin (hereinafter referred to as resin) is preferably from 2:1 to 1:16, more preferably from 1:2 to 1:8. For the amount of the resin less than the value above, it becomes difficult to stably include the low molecular weight organic material in the resin film and for more amount of resin, by contrast, a sufficient opaqueness cannot be achieved because of an insufficient amount of the low molecular weight organic material.

The present inventors have investigated a mechanism by which a reduction of the image density or contrast is caused upon repeated formation and erasure of the images on the reversible thermosensitive recording material. As a result, the following phenomena were observed when the image formation on the recording material was performed by pressing a heat generator, such as a thermal printhead against the surface thereof.

In the reversible thermosensitive recording material having a recording layer in which particles of the low molecular weight organic material are dispersed into a matrix resin, no strain as to cause a change of the state in which the components constituting the recording layer are present occurs. Energy for forming or erasing an image with the heat generator has not yet been applied or when the number of the repetition of the formation and erasure is small. In this case, the layer is as illustrated in FIG. 2(*a*), the particles (3) of the low molecular weight organic material are uniformly dispersed into the matrix resin (2). (As will be understood from the description hereinafter, the uniformity of the particles of the low molecular weight organic material is maintained in the recording material according to the present invention even after repeated recording and erasure operations.)

FIGS. 2(*a*) through 2(*d*) are schematic diagrams illustrating the changes of low molecular weight organic material particles in a recording layer of a conventional reversible thermosensitive recording material. The FIGS. illustrate a thermal printhead 1, a resin 2, low molecular weight organic material particles 3, a substrate 4 such as, a polyethylene terephthalate (PET) film, and a platen roller 5. Shear stress deforms the particles 7 of the low molecular weight organic material, forming an aggregated particle 8 of the deformed low molecular weight organic material particles, grown aggregates 9 of the deformed low molecular weight organic materials particles. Shear stress 6 is created in the direction opposite of the feeding direction 10 of the recording material.

When an image forming means such as the heat generator is displaced, under pressure, relative to the recording material for the formation of images, a stress is applied within the recording layer. Upon repeated application of the energy in the same direction, a strain is caused, as shown in FIG. 2(*b*), due to the stress, so that the particles of the low molecular weight organic material are deformed. As the energy application is further repeated in the same direction, the deformed particles of the low molecular weight organic material agglomerate with each other as shown FIG. 2(*c*). Finally, the agglomerated particles are further combined with each other to bring about a state where agglomeration of the particles of the low molecular weight material is maximized as shown in FIG. 2(*d*). In such a state, it is almost impossible to form an image and a so-called deteriorated state is reached. The lowering of the image density after repeated formation and erasure of images on reversible thermosensitive recording material is considered to be based on the foregoing phenomena.

In the present invention, the terms "level difference caused by heat and pressure" and "rate of change in level difference by heat and pressure" of a thermosensitive layer serving as an image forming section of a reversible thermosensitive recording material are defined as follows.

The term "level difference caused by heat and pressure" represents a physical property showing the hardness of a coated layer under a heated state. The smaller the level difference, the harder is the coated layer.

When the level difference caused by heat and pressure is 40% or less, the durability against repeated image formation and erasure with a thermal printhead or the like is significantly improved. The reason for this is considered to be that a force which inhibits the aggregation and expansion of the particles of the low molecular weight organic material by the contact of the particles with each other is suddenly increased so that the deformation of the thermosensitive layer upon application of heat and pressure with a thermal printhead or the like is minimized.

The level difference caused by heat and pressure is measured by the following method disclosed in Japanese Laid-Open Patent Applications No. 7-172072.

As a device for applying heat and pressure, a hot stamp-type air flowing table TC film erasure testing apparatus form Unique Machinery Inc is used.

The measurements are carried out under the following conditions. The pressure applied is adjusted with an air regulator such that the pressure value in the air gauge is 2.5 $kg/cm^2$ and the printing time is adjusted at 10 seconds with a timer. The heating temperature is then adjusted at 130° C. with a temperature controlling device. The heating temperature is the value which is subjected to the control of the heater and the temperature sensor and is approximately the same as the temperature at the surface of the thermal printhead.

The level difference caused by heat and pressure is measured by the following method using the above-mentioned apparatus.

A two-dimensional roughness analyzing device SURFCODER AY-41, a recorder RA-60E and SURFCODER SE30K from Kosaka Institute Inc. are used. First, SURFCODER SE30K is set at a vertical magnitude (V) of 2,000 and a lateral magnification (H) of 20. Then, SURFCODER AY-41 is set at a standard length (L) of 5 mm and a feed rate (D) of 0.1 mm/sec. The results of the measurements are recorded with the recorder RA-60E. From a chart recorded, the level difference (Dx) is read out. The above setting values represent an example and may be varied as desired. The measurements are carried out at six points D1–D6 spaced apart with a distance of 2 mm along the widthwise direction of the heat and pressure applying section. An average of the six measured values represent an average level difference (Dm).

From the average level difference (Dm) and a thickness of the thermosensitive recording layer (Ds), the level difference (D) is obtained according to the following equation:

$$D(\%)=(Dm/Ds)\times 1000,$$

wherein

D: level difference caused by heat and pressure,

Dm: average level difference (micron), and

Ds: thickness of the thermosensitive recording layer.

The thickness (Ds) of the thermosensitive recording layer formed on a supporting substrate may be determined by the analysis of the cross-section thereof with a transmission electron microscope (TEM) or a scanning electron microscope (SEM).

When the level difference caused by application of heat and pressure in the thermosensitive layer is 40% or less, there is obtained a contribution to improve the durability in repeated use. This is considered to be attributed to the fact that, as compared with the conventional recording materials, the level difference caused by application of heat and pressure in the thermosensitive layer is extremely smaller and the heat resistance and the mechanical strengths of the thermosensitive layer are excellent. Thus, the particles of the low molecular weight organic material contained in the thermosensitive layer are hardly agglomerated or maximized so that the deterioration during repeated formation and erasure of images is minimized to maintain a high image contrast.

To attain this purpose, the level difference caused by application of heat and pressure is 40% or less, preferably 30% or less, more preferably 25% or less, most preferably 20% or less.

The rate of change in level difference caused by application of heat and pressure in the thermosensitive layer is a property showing a change of the hardness of the coated layer upon lapse of time. The smaller the rate of change, the better the stability of the coated layer.

When the rate of the level difference is 70% or less, the effect of the present invention is significant, because this value is critical so that the stability in the thermal properties of the coated layer is significantly improved.

The rate of change in level difference is given by the following equation:

$$Dc(\%)=|(D_I-D_D)/D_I|\times 100,$$

wherein

Dc: rate of change in level difference caused by application of heat and pressure, $D_I$: initial level difference caused by application of heat and pressure(%), and $D_D$: deferred level difference caused by application of heat and pressure(%).

The initial level difference ($D_I$) is the value first measure after the formation of an image. It is not necessary that the measurement of the initial level difference be carried out immediately after the formation of the image.

The deferred level difference ($D_D$) is the value measured after storing a sample, similar to that used in the measurement of the initial level difference, at 50° C. for 24 hours. The initial and deferred level differences are measured and calculated according to the above-described method. When no level difference is found with the above conditions (2.5 kg/cm$^2$, 130° C.), it is possible to raise the pressure and/or temperature.

The foregoing method for the measurement of the level difference may be applied to both types of the previously described reversible thermosensitive recording materials of the invention, having either only a recording layer or one with a protective layer additionally provided.

When the rate of the level difference caused by application of heat and pressure in the thermosensitive layer is 70% or less, there is obtained contribution to improve the stability of the erasability characteristics by preventing the narrowing the temperature width for transparentization of the recording layer. This is considered to be attributed to the fact that the properties of the thermosensitive layer upon elapse of time do not change from initial state since the rate of change in level difference caused by application of heat and pressure of the thermosensitive layer of the recording material of the present invention is considerably small, so that the erasability characteristics do not vary upon elapse of time and are found stable.

To achieve this purpose, the rate of the level difference caused by application of heat and pressure is 70% or less, preferably 50% or less, more preferably 45% or less, most preferably 40% or less.

As a method for cross-linking the resin contained in the reversible thermosensitive layer, heating, ultraviolet irradiation (UV irradiation) or electron beam irradiation (EB irradiation) may be adopted. Preferably UV or EB irradiation, more preferably EB irradiation, is adopted, for the reasons described hereinafter.

The hardening of a resin by EB irradiation differs from that by UV irradiation in that the latter method needs a photopolymerization initiator and a photosensitizer and is effective only to a transparent resin only. With the EB irradiation method, a radical reaction rapidly proceeds so that the polymerization is completed instantaneously. Further, because of a high energy of EB irradiation, the layer to be hardened can be made thick. With the UV irradiation method, the photopolymerization initiator and the photosensitizer, remain in the cross-linked recording layer and might adversely affect the formation and erasure operations and the durability of repeated operations.

A thermal hardening method requires the use of a catalyst and a promoter for cross-linking. Even with these additives, the hardening proceeds much slower than that with the EB irradiation method. In addition, these additives remain in the cross-linked recording layer and might cause problems similar to those in the UV irradiation method. Moreover, the cross-linking proceeds slowly after heating, so that the characteristics of the recording layer will change upon lapse of time.

The resin contained in the reversible thermosensitive layer maybe cross-linked by heating, ultraviolet light irradiation (UV irradiation) or electron beam irradiation (EB irradiation) may be adopted. Specific examples of the cross-linking method include: (1) a method in which cross-linkable resin is used; (2) a method in which a cross-linking agent is additionally used; (3) a method in which the cross-linking is carried out by irradiation with ultraviolet light or electron beams; and (4) a method in which the cross-linking is carried out by irradiation with ultraviolet light or electron beams in the presence of a cross-linking agent.

For the above reasons, the cross-linking by EB irradiation is best suited. Additionally, the recording materials obtained using EB irradiation can prevent the deterioration of the density of an image formed by a high energy printing and can maintain high contrast.

Examples of cross-linking agents useful in the present invention include but are not limited to oligomers of; urethane acrylate, epoxy acrylate, polyester acrylate, polyether acrylate, vinyl compound, and unsaturated polyester; and monomers of monofunctional or polyfunctional acrylate, methacrylate, vinyl ester, styrene derivatives, and allyl compound. In addition, non-functional or functional monomers as those disclosed in Japanese Laid-Open Patent Application No. 7-172072 may suitably be employed in the present invention.

As described previously, among the above-described cross-linking agents, the functional monomer is preferred to the non-functional monomer and the polyfunctional monomer is preferable to the monofunctional monomer, for reasons of better cross-linking efficiency with a smaller amount.

When irradiation with ultraviolet light is adopted to cross-link the resin of the thermosensitive layer, the following cross-linking agents (without limitation), photopolymerization initiators and photopolymerization accelerators may be used.

The cross-linking agents may broadly be divided into photopolymerizable prepolymers and photopolymerizable monomers. The prepolymer compounds may be polyester acrylates, polyurethane acrylates, epoxy acrylates, polyether acrylates, oligoacrylates, alkyd acrylates and polyol acrylates. Monofunctional monomers and polyfunctional monomers may be used as the cross-linking agents for irradiation with electron beams.

The photopolymerization initiators may generally be divided into those of a radical reaction type and those of ionic reaction type. The former compounds may further be divided into those of a light cleavage type and those of a hydrogen abstraction type. Specific examples of the initiators are those disclosed in Japanese Laid-Open Patent Application No. 7-172072.

These initiators are used individually or in combination. The amount of an initiator is preferably from 0.005 to 1.0 part by weight, more preferably from 0.01 to 0.5 part by weight, per part by weight of the cross-linking agent.

The photopolymerization accelerator serves to improve the curing speed of the photopolymerization initiators of a hydrogen abstraction type such as benzophenone series and thioxanthone series. Aromatic tertiary amines and aliphatic amines are generally used. Specific examples of the accelerators include isoamyl-p-dimethylaminobenzoate and ethyl-p-dimethylaminobenzoate. The accelerators are used singly or in combination with two or more of the accelerators. The amount of the accelerator to be added to resin is preferably from 0.1 to 5 parts by weight, more preferably from 0.3 to 3 parts by weight, per part by weight of the photopolymerization initiator.

The ultraviolet light irradiation apparatus used in the present invention should be chosen so that its emission spectrum corresponds to the absorption spectra of the photopolymerization initiators and accelerators. Irradiation conditions for the cross-linking reaction such as lamp output and conveying speed, may be suitably selected according to the radiation energy required for cross-linking resins, as is known in the art.

Similarly, an electron beam irradiation apparatus may either be scanning beam type and a non-scanning (i.e. area beam) type, chosen according to desired irradiation area and irradiation doses.

The electron beam irradiation conditions are determined from the following equation according to the dosage required for cross-linking the resin in view of the electron current, irradiation width and conveyor speed:

| | | |
|---|---|---|
| | $D = (\Delta E/\Delta R)_E\eta_EI/(W_EV)$, | |
| wherein | D | dosage required (Mrad), |
| | $\Delta E/\Delta R$ | average energy loss, |
| | $\eta$ | irradiation efficiency, |
| | I | electron beam current (mA), |
| | W | irradiation width (cm), and |
| | V | conveyor speed (cm/sec). |

For industrial purposes, this is simplified as

D_EV=K_EI/W and the irradiation rating is expressed in terms of Mrad m/min.

Electron current rating is from 20 to 30 mA in the case of an experimental apparatus, from 50 to 100 mA in the case of a pilot machine, and from 100 to 500 mA in the case of production machine.

The cross-linking efficiency varies with the kind and degree of polymerization of the resin, the kind and amount of the cross-linking agents and the kind and amount of plasticizers, so that the gel fraction relative to the dosage is not a constant. Therefore, the dosage required for cross-linking the resin is suitably determined according to the target gel fraction which has been determined from a recording layer prepared using predetermined levels of constituents of the reversible thermosensitive recording material.

When a higher energy is required for cross-linking the resin, it is preferred that the irradiation is carried out in several doses to avoid overheating, so that the supporting substrate, the resin or the like does not deform or thermally decompose. Electron beam irradiation for cross-linking should preferably be performed after the recording layer has been heated to a temperature sufficient to melt at least part, and preferably all of the low molecular weight organic material contained therein.

The relationship between the thermosensitive layer constituents and the gel fraction is as follows:

The resin is selected from those described above. Since the gel fraction tends to increase as the average polymerization degree (P) increases, the polymerization degree of the resin is preferably such that P is 300 or greater, more preferably P is 600 or greater.

The kind and the amount of the cross-linking agents are as described previously. The kind of the plasticizer is preferably a fatty acid ester, polyester plasticizer or epoxy resin plasticizer among those described previously.

The use of an epoxy plasticizer is particularly preferred for reasons of discoloration by irradiation and cross-linking efficiency. As the amount of the plasticizer increases, the gel fraction is improved and, thus is preferably from 0.01 to 1.0 parts by weight, more preferably from 0.05 to 0.5 parts by weight per part by weight of the resin.

In addition to the foregoing methods, the following methods are effective to improve the durability in repeated use:

Firstly, the durability is improved by increasing the softening point of the recording layer. The higher the softening point is, the better the durability. The softening temperature may be measured with a thermal machine analyzer (TMA) or dynamic visco-elasticity measurement apparatus using a membrane similar to that used in the gel fraction measurement. The softening point is also measured with a rigid body pendulum method or dynamic viscoelasticity measurement apparatus without peeling off the recording layer prepared as above.

Secondly, as described hereinafter, the durability may be improved by laminating a protective layer over the thermosensitive and by strengthening adhesion between these layers. The higher the adhesion strength, the better the durability. The adhesion strength may be measured according to the method UM-403 defined by TAPPI (Technical Association of the Pulp and Paper Industry).

Thirdly, the durability is high when the penetration depth of a probe needle into the recording layer is less. The penetration depth may be measured using TMA used in the softening point measurement with the probe needle. The probe needle (or penetration probe) having a small tip cross-sectional area is placed on a recording layer and applied with prescribed amount of weight, if necessary, at elevated temperatures, to measure the displacement of the probe.

Fourthly, the durability is higher when the residual amount of the cross-linking agents remaining in the recording layer after EB cross-linking is small.

The residual amount of the cross-linking agents may be measured as follows.

An attenuated total reflection (ATR) auxiliary unit mounted to a Fourier transform infrared spectrometer is used as the measuring device and a thermosensitive coated layers used in the aforementioned measurements are used as the sample for the present measurements. The sample (after irradiation with EB) is measured for the infrared absorption band intensity attributed to a CH out-of-plane deformation vibration of an acryloyl group at 810 $cm^{-1}$.

The absorption band intensity is proportional to the residual amount of the cross-linking agent. Namely, the intensity decreases with a decrease of the residual amount. Thus, the residual amount can be determined from the above measurement.

In the present invention, the residual amount of the cross-linking agents is suitably 0.2 part by weight or less, preferably 0.1 part by weight or less, more preferably 0.05 part by weight or less, most preferably 0.01 part by weight or less, per part by weight of the resin in the thermosensitive recording layer.

In addition, when a space, which has a refractive index different from that of the matrix resin or the low-molecular-weight organic material particles in the thermosensitive layer is present in the interface between the resin and the particles and/or within the particles, the image density of the white opaqueness is improved and, thus, the contrast is improved. This effect is more significant when the size of the space is 1/10 or more of the wavelength of the light used for detecting the opaqueness.

As aforementioned, a thermosensitive recording layer may be heated so as to give rise to white opaque images on a transparent background or vice versa and this image formation can be repeated for many times. When a color sheet is placed on the back side of such a recording layer, images are in that color on a white opaque background or in white opaque on a background of that color. Furthermore, when a recording layer is used as a transparent sheet for an overhead projector (OHP), white opaque portions come out to be dark and transparent portions to be bright on a screen.

It is preferred that the recording layer have a thickness of from 1 to 30 microns, more preferably from 2 to 20 microns. Too large a thickness of the recording layer causes a difficulty in uniformly transparentizing the recording layer since a temperature variation occurs in the layer. Too small thickness of the recording layer, on the other hand, causes a reduction of the white opaqueness and the contrast. By increasing the amount of the low molecular weight organic material in the thermosensitive layer, the white opaqueness can be increased.

The recording material is prepared, for example, by one of the following methods. The recording layer of the recording material of the present invention may be formed on a substrate or by itself without a substrate.

(1) A recording layer coating composition in which a resin and a low molecular weight organic material is dissolved or dispersed is coated on a substrate and dried to form a recording layer on the substrate while being cross-linked. Alternatively, a coated recording layer is cross-linked after the recording layer is dried and released from the substrate.

(2) A resin is dissolved in a solvent in which only the resin can be resolved. Into the resin solution prepared as above, a low molecular weight organic material which has been pulverized by various means is dispersed to form a coating composition. The coating composition is coated on a substrate to displace the solvent and to form a film or sheet of a recording layer while being cross-linked. Alternatively, a coated layer is cross-linked after the layer is dried and released from the substrate.

(3) A resin and a low molecular weight organic material are mixed and melted to prepare a coating mixture without a solvent, to be formed as a film or sheet, to be cooled, and to thus prepared as a recording layer while being cross-linked.

Suitable solvents for use in the recording layer coating composition include tetrahydrofuran, methyl ethyl ketone, methyl isobutyl ketone, chloroform, carbon tetrachloride, ethanol, toluene and benzene. The solvent may be selected depending on the kind of the resin and the low molecular weight organic material. When a recording layer coating composition is a solution as well as a dispersed system, the low molecular weight organic material precipitate as the form of dispersed minute particles in a resultant recording layer.

In the reversible thermosensitive recording medium, it is preferable to employ such a matrix resin that can form a thermosensitive recording layer in the form of film, and impart high transparency and mechanical stability for the recording layer.

Illustrative examples of the resin useful for the matrix of the present invention include but are not limited to polyvinyl chloride; vinyl chloride copolymers such as vinyl chloride-vinyl acetate copolymer, vinyl chloride-vinyl acetate-vinyl alcohol copolymer, vinyl chloride-vinyl acetate-maleic acid copolymer, vinyl chloride-acrylate copolymer, vinyl chloride-vinyl ester of fatty acid (with at least three carbon atoms) copolymer and vinyl chloride-ethylene copolymer; vinylidene chloride copolymers such as polyvinylidene chloride, vinylidene chloride-vinyl chloride copolymer and vinylidene chloride-acrylonitrile copolymer; polymethylmethacrylate and methacrylate copolymer.

These resins are further used in the present invention in combination with one or more of resins, such as saturated polyester, polyethylene, polypropylene, polystyrene, polymethacrylate, polyamide, polyvinylpyrrolidone, natural rubber, polyacrolein, or polycarbonate and copolymer thereof.

In addition, there are also employed polyacrylate, polyacrylamide, polysiloxane, polyvinyl alcohol or copolymer thereof.

Among the above-mentioned resins, those having none of carboxyl, hydroxy, sulfonic, or epoxy group in their structure are particularly preferable in the present invention, in view of preventing reactions between the aforementioned basic material, thereby causing no change in softening temperature of the matrix resin.

The average degree of polymerization P is preferably at least 300, and more preferably at least 600. The copolymerization ratio of the copolymers is preferably such that the weight ratio of the vinyl chloride unit to the polymerizing monomer unit is preferably from 90/10 to 40/60, more preferably from 85/15 to 50/50. In addition, the glass transition temperature (Tg) of the matrix resin in the present invention is preferably 100° C. at the highest, more preferably 90° C. at the highest, and most preferably 80° C. at the highest.

The recording layer may contain, in addition to the above constituent materials, additives such as a plasticizer and a surfactant to facilitate the formation of transparent images.

As the plasticizers useful for the present invention are esters of phosphoric acid, fatty acid, phthalic acid, or dibasic acid; glycols, polyester plasticizers, and epoxy plasticizers.

Specific examples of the plasticizers in the present invention include tributyl phosphate,
tri-2-ethylhexyl phosphate,
triphenyl phosphate,
tricresyl phosphate,
butyl oleate,
dimethyl phthalate,
diethyl phthalate,
dibutyl phthalate,
dihepthyl phthalate,
di-n-octyl phthalate,
di-2-ethyhexyl phthalate,
diisononyl phthalate,
dioctyldecyl phthalate,
diisodecyl phthalate,
dibutyl adipate,
di-n-hexyl adipate,
di-2-ethylhexyl adipate,
di-2-ethylhexyl azelate,
dibutyl sebacate,
di-2-ethylhexyl sebacate,
diethyl glycol dibenzoate,
triethylene glycol di-2-ethylbutylate,
methyl acetylricinoleate,
butyl acetylricinoleate,
butylphtalyl butyl glycolate, and
tributyl acetyl citrate.

Specific examples of the surfactant and other additives include:

higher fatty acid esters of a polyhydric alcohol,
higher alkyl ethers of a polyhydric alcohol,
a higher alcohol,
a higher alkyl phenol,
a higher fatty acid higher alkyl amine,
a higher fatty acid amide;
a fat or lower olefin oxide adducts of polypropylene glycol;
acetylene glycol;

Na, Ca, Ba or Mg salts of higher alkyl benzenesulfonic acid;

Na, Ca, Ba or Mg salts of an aromatic carboxylic acid, a fatty acid sulfonic acid, aromatic sulfonic acid, sulfuric acid monoester or mono or diester of phosphoric acid;

low degree sulfonated oil;

poly(long chain alkyl acrylate);

acrylic oligomers;

poly(long chain alkyl methacrylate);

copolymers of long chain alkyl methacrylate with amine-containing monomer;

styrene-maleic anhydride copolymers; and olefin-maleic anhydride copolymers.

In the present invention, a thermosensitive recording material which gives rise to color formation is also utilized in the recording layer. This color formation is caused by a reaction of a coloring agent such as an electron donating coloring compound with a color developer such as an electron accepting compound.

When such a composition as mentioned above, which consists of the electron donating coloring compound and the electron accepting compound is heated to a temperature high enough to be melted, a colored amorphous compound is formed. By contrast, when the colored amorphous compound is heated to a temperature below its melting point, the compound turns to be colorless upon crystallization. It is the above-mentioned coloring/erasing property of this coloring compound that is utilized in the present invention for reversible thermosensitive recording.

A colored state of the amorphous colored compound results instantaneously upon melting and is stable at ambient temperatures. In addition, a colorless state which is instantaneously formed by heating the colored amorphous compound at a temperature below its melting point is also stable at ambient temperatures. It can be noted that this reversible coloring/erasing change is quite remarkable, which is detailed hereinafter.

Figure 3:
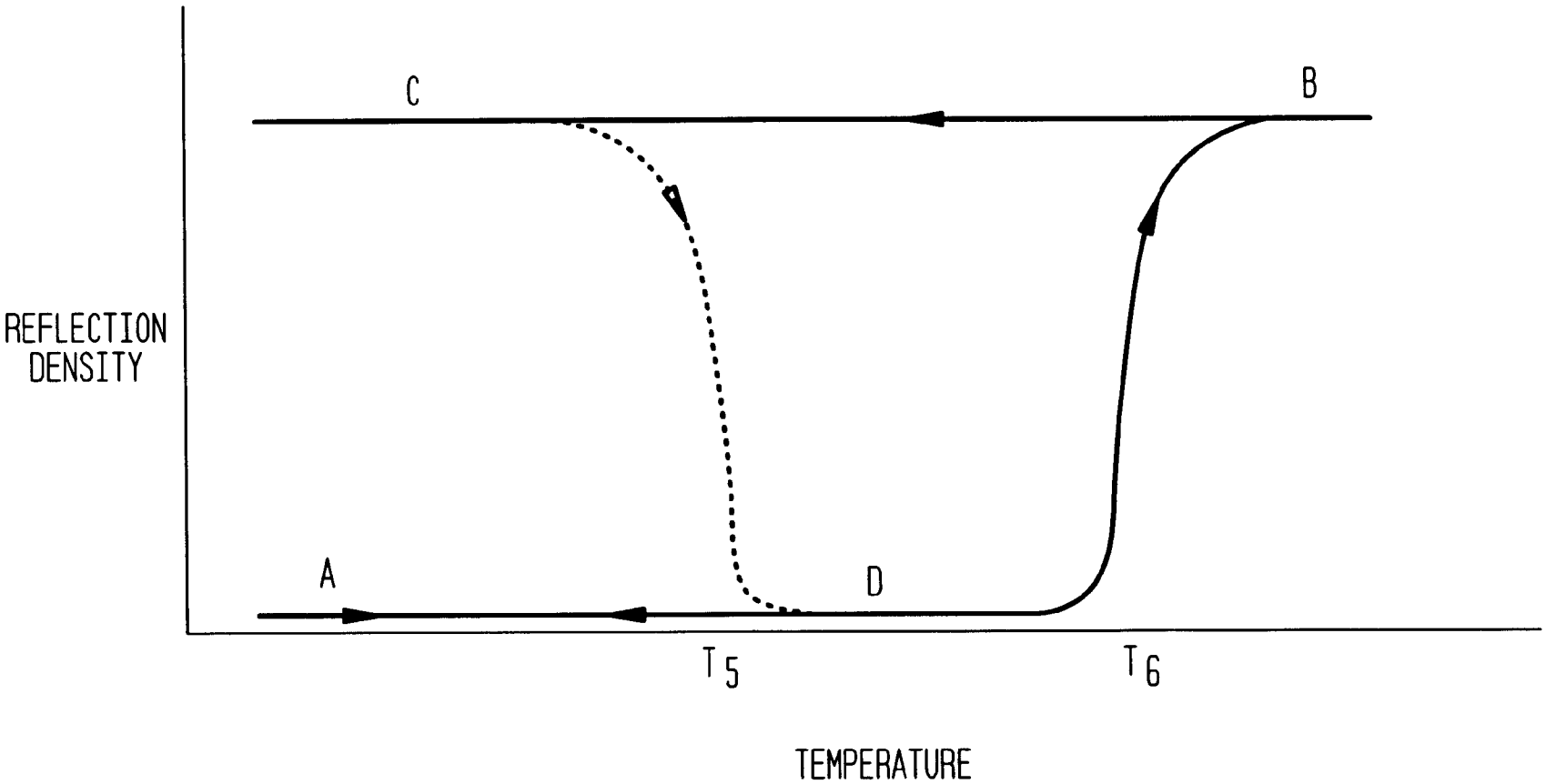
FIG. 3 is a graph showing a relationship between the temperature and the color density.

In FIG. 3, the relationship of the color image density vs. temperature is illustrated. An image forming process is shown by a solid curve, and an image erasing process is shown by a dotted curve. The character A in FIG. 3 denotes an optical density of the recording material in which images are completely erased. When a recording material is heated to a temperature above $T_6$, the material becomes colored (B); remains colored (C), when cooled to a temperature below $T_5$; and becomes erased (D), when subsequently heated to a temperature between $T_5$ and $T_6$.

The recording material with this composition is in a colorless state (a first color state) or the state (A) at a temperature below $T_5$. When the recording material is heated at a temperature above $T_6$ with a thermal print head, for example, the recording material becomes colored (B), resulting in formation of an image. The formed color image of the recording material remains at the colored state C (a second colored state), when the recording material is cooled to a temperature below $T_5$, as shown by a solid curve ABC in FIG. 3.

When the recording material having the formed images is heated to a temperature between $T_5$ and $T_6$ which is lower than a coloring temperature, the recording material becomes a colorless (D) and the image is erased. If the colorless recording material is cooled to a temperature below $T_5$, the colorless state is maintained to reach the state (A), as shown as the change CDA in FIG. 3. This image forming and erasing operations can be repeated reversibly.

In addition, by carrying out the erasing succeeding to the heating of the recording layer above $T_6$, the particles of the coloring agent and color developer returns to the original state, which facilitates to regenerate the colored state.

This thermosensitive material includes a coloring agent and a color developer as essential components as aforementioned, and may further includes a binder resin.

A conventional reversible thermosensitive recording material includes a composition of a coloring agent such as a leuco compound having a lacton ring and a color developer such as a phenolic compound. When this composition melts by heating, the leuco compound becomes colored due to opening of the lacton ring, thereby forming a color image. The colored image is an amorphous substance in which the leuco compound and the phenolic compound are dissolved together. Although the amorphous substance is stable even at room temperature, it does not become colorless when heated again. The reason for this change is considered as follows. In this composition, the phenol compounds is neither separated from the leuco group nor produce the ring disclosure in the lacton group, thereby resulting in no colorless state.

On the other hand, in the present invention, the composition of the coloring agent and the color developer form a colored amorphous substance, when the composition is heated again to a temperature below the coloring temperature. In addition, since the color developer crystallizes and separates from the coloring agent due to the weakening in the bonding between the coloring agent and the coloring developer, electron donation and acceptance between the coloring agent and the color developer do not occur, the composition can become colorless.

The coloring agent and the color developer for use in the recording material of the present invention include known electron donating agents and known electron accepting color developers. However, these materials should be combined so that a colored amorphous substance is formed when heated, and the color developer crystallizes when the colored amorphous substance is heated again at a temperature below the coloring temperature. By thermal analysis, melting of these materials is found to be endothermic and crystallization of a color developer is found to be exothermic.

This type of reversible thermosensitive recording material (reversible thermosensitive coloring material) may include auxiliary agents such as a binder resin. Even when a binder resin is included in the recording layer, the reversible coloring/erasing operations can be maintained.

Specific examples of the binder resin include the resins as aforementioned in the aforementioned reversible thermosensitive recording material.

In addition, since the color erasing is caused by the crystallization and following separation of the color developer from the coloring agent, appropriate selection of the color developer is important to achieve excellent erasing characteristics.

When the reversible thermosensitive recording medium is used in a reflection mode for displaying images, it is preferred that a light reflecting layer be provided behind the recording layer. The reflecting layer can increase the contrast even when the thickness of the recording layer is relatively small. Specifically, the light reflecting layer may be formed by deposition of aluminum, nickel, or tin, for example, on the supporting substrate, as described in Japanese Laid-Open Patent Application No. 64-14079.

A protective layer may further be provided on the recording layer to protect the same from damage or deterioration. Suitable materials for the protective layer having a thickness of from 0.1 to 10 microns include silicone rubber or silicone resin (Japanese Laid-Open Patent Application No. 63-221087), polysiloxane graft polymer (Japanese Laid- Open Patent Application No. 63-317385), and ultraviolet curing resin or electron beam hardening resin (Japanese Laid-Open Patent Application Nos. 1-133781 and 2-566).

In any case, a solvent is used for coating the protective layer, and the solvent used is such that the resin or the low molecular weight organic material of the recording layer are hardly soluble in that solvent.

Specific examples of the above-mentioned solvents include n-hexane, methyl alcohol, ethyl alcohol, and isopropyl alcohol. In particular, the use of alcohol based solvents is desirable from the standpoint of the costs.

The protective layer may be cured simultaneously with the cross-linking of the resins of the recording layer. In this case, after the recording layer has been formed on the supporting substrate in the manner previously described, the protective layer is coated and dried. Then the electron beam irradiation is carried out using the aforementioned EB irradiation apparatus and irradiation conditions for curing both the recording and the protective layers.

It is preferred that the protective layer has a thickness of from 0.5 to 10 microns. A thickness of the protective layer below 0.5 micron causes a difficulty in protecting the recording layer, whereas a thickness of the layer above 10 microns causes a reduction of thermal sensitivity of the recording layer.

In the present invention, a color printed layer is further provided. The color printed layer may be formed with a coloring agent and a heat resistant resin. As the coloring agents, a dye or pigment conventionally used in color ink for the full color printing may be used. The binder resin may be thermoplastic, thermosetting, UV curable, or EB hardening resin. The thickness of the color printed layer is adjusted such that a desired optical density of printed color can be obtained.

In the present invention, a heating element matching layer is further provided on top of the protective layer to achieve efficient heat transfer from heating elements. The matching layer may be formed with an inorganic pigment and a heat resistant resin. The resins exemplified as resin materials in the protective layer may also be preferably used as the heat resistant resin in the matching layer. Examples of the inorganic pigments may include but not limited to calcium carbonate, kaolin, silica, aluminum hydroxide, alumina, aluminum silicate, magnesium hydroxide, magnesium carbonate, magnesium oxide, titanium oxide, zinc oxide, barium sulfate and talc.

The diameter of the particles of the inorganic pigment is preferably from 0.01 to 10 microns, more preferably from 0.05 to 8 microns. These inorganic pigments are used individually or in combination in the matching layer. The amount of the inorganic pigment is preferably from 0.01 to 2 parts by weight, more preferably from 0.05 to 1 part by weight, per part by weight of the heat resistant resin.

The agents previously exemplified as the UV curing agents for the thermosensitive recording layer may also be used in the present invention for UV curing the resin used in the protection, color printed, and matching layers as cross linking agents, photopolymerization initiators, and photopolymerization accelerators.

In addition, an intermediate layer may be interposed between the protective layer and the recording layer to protect the recording layer from the solvents or a monomer component for the protective layer formation liquid, as disclosed in Japanese Laid-Open Patent Application No. 1-133781.

In addition to the resins exemplified as the matrix resin material for the recording layer, the following thermosetting resins and thermoplastic resins may be used as the material for the intermediate layer: polyethylene, polypropylene, polystyrene, polyvinyl alcohol, polyvinyl butyryl, polyurethane, saturated polyester, unsaturated polyester, epoxy resin, phenolic resin, polycarbonate, and polyamide. The thickness of the intermediate layer is preferably from 0.1 to 2 microns.

As the layer construction of the reversible thermosensitive recording material of the present invention, there may be mentioned a construction in which, as disclosed in Japanese Laid-Open Utility Model Application No. 2-3876, includes a thermosensitive recording layer and a magnetic recording layer containing a magnetic material as a main ingredient thereof on a supporting substrate such that at least the portion immediately below the thermosensitive recording layer or the portion of the supporting substrate corresponding to the thermosensitive recording layer is colored.

Alternatively, as disclosed in Japanese Laid-Open Patent Application No. 3-130188, there may be mentioned a construction in which a supporting substrate is overlaid with a magnetic recording layer, a light reflecting layer and a thermosensitive layer in this order. In this case, the magnetic recording layer may be provided either on the backside of the supporting substrate or between the supporting substrate and thermosensitive layer. Other layer constructions may be used, if desired.

A colored layer may further be provided between the supporting substrate and the recording layer to improve the visibility. The color layer may be formed by applying and drying a solution or a dispersion containing, as main ingredients, a coloring agent and a resin binder or applying a color sheet.

Any color agent may be used as long as it permits the recognition of change between transparency and white opaqueness of the overlying recording layer as a reflected image. A dye or pigment of red, yellow, blue, deep blue, violet, black, brown, gray, orange, or green may be used. The binder resins useful in the color layer may be a thermoplastic, thermosetting or UV-curable resins.

An air layer of air-containing, non-adhesion portion may be interposed between the recording layer and the supporting substrate.

Since the index of refraction of low-molecular-weight organic materials used as main ingredient of the recording layer is from 1.4 to 1.6 and is quite different from that of air (1.0), light is reflected on the interface between the non-adhesion portion and the film on the thermal recording layer side. Thus, the air layer serves to amplify the white opaqueness of the recording layer in the clouded state, thereby improving the visibility. It is therefore desirable to use the non-adhesion portion as a displaying section.

Since the non-adhesion portion, which contains air therewithin, serves as a heat insulating layer, the heat sensitivity of the recording medium is improved. In addition, the non-adhesion portion serves to function as a cushion, the pressure applied to the recording layer by a thermal printhead is small, so that the recording layer is prevented from deforming, and the particles of the low molecular weight organic materials are prevented from expanding by the heat application. Thus, the durability in repeated use may be improved.

A layer of an adhesive may further be provided on the backside of the supporting substrate to form a reversible thermosensitive recording label. The label sheet is applied to a body to be mounted such as a vinyl chloride card (credit card), an IC card, an ID card, a paper, a film, a synthetic paper, a boarding card or a commuting ticket. The body to be mounted is not limited to the above specific examples. If desired, an adhesive layer may be interposed between the supporting substrate and the thermosensitive layer (Japanese Laid-Open Patent Application No. 3-7377), when the supporting substrate is made of a material such as, for example, an aluminum layer which poorly adheres to the resin.

The methods of forming and erasing an image according to the present invention are as follows.

There is one image forming and erasing method in which the common heating element such as, for example, a thermal printhead is used as image forming and erasing means. In this case, a different energy input is applied to the heating element for each of the recording and erasing processes. In another method, a thermal printhead is used as the image forming means, while one of contact and pressing type means is used as the image erasing means, such as a thermal printhead, a ceramic heater, a hot stamp, a heat roller or a heat block, or one of non-contact type means using hot air or infrared radiation.

In the reversible thermosensitive recording material of the present invention, when the recording layer as a whole has a cross-linked structure, the recording layer inclusive of the low-molecular-weight organic material is not distorted so that the image formation and erasure of the recording layer may always be suitably carried out with the excellent durability.

Having generally described this invention, a further understanding can be obtained by reference to certain specific examples which are provided herein for purposes of illustration only and are not intended to be limiting. In the description in the following examples, numerals are in weight ratio unless otherwise indicated.

EXAMPLES

Example 1

A reversible thermosensitive recording medium of the present invention was fabricated in accordance with steps and apparatus which follow.

A layer of aluminum was deposited to form a light reflecting layer onto a supporting substrate of transparent polyester film (188 micron thick) with a thickness of 400 A sing a conventional vacuum evaporation apparatus.

A mixture of the following components was prepared to obtain a coating composition for an adhesive layer.

| | |
|---|---|
| Vinyl chloride-vinyl acetate-phosphoric ester copolymer (Denka-vinyl #1000P from Denki Kagaku Kogyo Co.) | 5 parts |
| Tetrahydrofuran | 95 parts |

The coating composition prepared as above was coated on the above light reflecting layer, and dried to form an adhesive layer having a thickness of 1.5 micron.

To obtain a coating composition for a thermosensitive recording layer, a mixture of the following components was prepared.

| | |
|---|---|
| 1,18-octadeca-dicarboxylic acid dodecyl m.p. 62° C. (Miyoshi Oil and Fat Co.) | 4.75 parts |
| Cupric stearate m.p. 125° C. | 5.25 parts |
| Vinyl chloride-vinyl acetate copolymer (80:20 copolymer, M2018 from Kaneka Co. average polymerization degree = 1800) | 28 parts |
| Dipenta-erythritol hexa-acrylate ∈-caprlolactone adduct (KAYARAD DPCA-30 from Nihon Kayaku Co.) | 4.7 parts |
| Tetrahydrofuran | 215.5 parts |
| Amyl alcohol | 24 parts |
| Dibutyltin laurate stabilizer (Stann SCAT-1 from Sankyo Yuuki Gosei Co.) | 0.8 part. |

The coating composition thus prepared was coated on the adhesive layer, and vacuum-dried to form a thermosensitive recording layer with a thickness of 8 microns.

The recording layer prepared as above was subsequently irradiated with an area-beam electron beam irradiation apparatus, Model EBC-200-AA2 from Nisshin High Voltage Co. with a resultant dosage of 10 Mrad.

To obtain a coating composition for a barrier (or protective) layer, a mixture of the following components was prepared.

| | |
|---|---|
| Vinyl chloride-vinyl acetate copolymer (M2018 from Kaneka Co.) | 10 parts |
| Ultraviolet hardening resin (Unidic C4-782 from Nihon Ink Co.) | 2.5 parts |
| Tetrahydrofuran | 87.5 parts. |

The thus prepared solution was coated, dried, and hardened under an ultraviolet lamp of 80 W/cm to form a protective layer with a thickness of 2 microns, thereby obtaining a reversible thermosensitive recording medium.

To obtain a coating composition for a protective layer, a mixture of the following compositions was prepared.

75% solution of urethane acrylate-based ultraviolet hardening resin (Unidic C7-157 from Nihon Ink Co.)

| | |
|---|---|
| 75% solution of urethane acrylate-based ultraviolet hardening resin (Unidic C7-157 from Nihon Ink Co.) in butyl acetate | 10 parts |
| Isopropyl alcohol | 10 parts |

The thus prepared composition was coated with a wire bar, dried, and then hardened under an ultraviolet lamp of 80 W/cm, thereby obtaining a reversible thermosensitive recording medium with a thickness of 3 microns.

Example 2

A reversible thermosensitive recording medium was fabricated in a similar manner to Example 1, with the exception that octadecyl stearate (m.p. 62° C., from Sigma Co.) was used in place of 1,18-octadeca-dicarboxylic acid dodecyl (m.p. 62° C., form Miyoshi Oil and Fat Co.) in Example 1.

Example 3

A reversible thermosensitive recording medium was fabricated in a similar manner to Example 1, with the exception that 1,18-butanediol distearate (m.p. from 670 to 71° C., BD-36 from Miyoshi Oil and Fat Co.) was used in place of 1,18-octadeca-dicarboxylic acid dodecyl (m.p. 62° C., from Miyoshi Oil and Fat Co.) in the thermosensitive layer of Example 1.

Example 4

A reversible thermosensitive recording medium was fabricated in a similar manner to Example 1, with the exception that octacosane (m.p. 61° C., from Tokyo Kasei Co.) was used in place of 1,18-octadeca-dicarboxylic acid dodecyl in the thermosensitive layer of Example 1.

Comparative Example 1

A reversible thermosensitive recording medium was fabricated in a similar manner to Example 1, with the exception that eicosanedionic acid (m.p. 110°–125° C. from Okamura Oil and Fat Co.) was used in place of cupric stearate in the thermosensitive layer of Example 1.

Comparative Example 2

A reversible thermosensitive recording medium was fabricated in a similar manner to Example 1, with the exception that behenic acid (m.p. 80° C., from Sigma Co.) and eicosanedionic acid were used respectively in place of 1,18-octadeca-dicarboxylic acid dodecyl and cupric stearate in the thermosensitive layer of Example 1.

Example 5

A reversible thermosensitive recording medium was fabricated in a similar manner to Example 1, with the exception that a mixture of the following components was used as a coating composition for a thermosensitive recording layer.

| | |
|---|---|
| Ethanolamine distearate m.p. 80° C. (Suri-aide from Nihon Kasei Co.) | 5 parts |
| Palmitic acid amide m.p. 100° C. (Diamide KP from Nihon Kasei Co.) | 5 parts |
| vinyl chloride-vinyl acetate copolymer (VYHH from Union Carbide Co.) | 39 parts |
| DPCA-30 (KAYARAD DPCA-30 from Nihon Kayaku Co.) | 4.7 parts |
| Tetrahydrofuran | 178.2 parts |
| Ethyl Cellosolve | 44.5 parts |
| Dibutyltin laurate stabilizer (Stann SCAT-1 from Sankyo Yuuki Gosei Co.) | 0.8 part. |

Example 6

A reversible thermosensitive recording medium was fabricated in a similar manner to Example 5, with the exception that high grade stearamide (m.p. 107° C. from Nihon Ayaku Co.) was used in place of palmitic acid amide in the thermosensitive recording layer of Example 5.

Example 7

A reversible thermosensitive recording medium was fabricated in a similar manner to Example 5, with the exception that methylolstearamide (m.p. 111° C., methylolamide from Nihon Kasei Co.) was used in place of palmitic acid amide in the thermosensitive recording layer of Example 5.

Comparative Example 3

A reversible thermosensitive recording medium was fabricated in a similar manner to Example 5, with the exception that behenic acid behenyl (m.p. 75° C., Sigma Co.) and ethylenebisbehenic acid amide (m.p. 141° C., Suribacks B from Nihon Kayaku Co.) were respectively used in place of ethanolamine distearate and palmitic acid amide in the thermosensitive layer of Example 5.

Comparative Example 4

A reversible thermosensitive recording medium was fabricated in a similar manner to Example 5, with the exception that 9.5 parts of behenic acid behenyl (m.p. 75° C., Sigma Co.) and 0.5 part of ethylenebisbehenic acid amide (m.p. 141° C., Suribacks B from Nihon Kayaku Co.) were respectively used in place of 5 parts of ethanolamine distearate and 5 parts of palmitic acid amide in the thermosensitive layer of Example 5.

Comparative Example 5

A reversible thermosensitive recording medium was fabricated in a similar manner to Example 5, with the exception that behenic acid (m.p. 80° C., Sigma Co.) and eicosanedionic acid (m.p. 110°–125° C., SL-20-99 from Okamura Oil and Fat Co.) were respectively used in place of ethanolamine distearate and palmitic acid amide in the thermosensitive layer of Example 5.

The thus fabricated reversible thermosensitive recording media from Example 1 through Comparative Example 4 were measured for their properties given below and the results are shown in Tables 1 through 4.

Measurement of Rate of Change in Recording Sensitivity

A reversible thermosensitive recording medium was subjected to the measurement of reflection optical densities according to the method and the device previously described.

After a background density (ODB) at a most transparent state and an initial white opaque density (ODWI) of the recording medium were measured, the thermosensitive medium was immersed for 199 hours in the artificial perspiration liquid prepared as aforementioned and then dried. The resulting medium was subjected to reflection density measurements to obtain a deferred white opaque density (ODWD). From the thus obtained values of ODB, ODWI and ODWD, the rate of the change in the recording sensitivity was calculated. The results are shown in Table 1.

TABLE 1

| Example | Initial white opaque density (ODWI) | Deferred white opaque density (ODWD) | Background density (ODB) | Rate of change in recording sensitivity (%) |
|---|---|---|---|---|
| 1 | 0.25 | 0.27 | 0.95 | 2.9 |
| 2 | 0.27 | 0.30 | 0.97 | 4.3 |
| 3 | 0.29 | 0.31 | 1.00 | 2.8 |
| 4 | 0.26 | 0.27 | 1.02 | 1.3 |
| 5 | 0.26 | 0.27 | 1.35 | 0.9 |
| 6 | 0.26 | 0.28 | 1.45 | 1.7 |
| 7 | 0.27 | 0.39 | 1.38 | 10.8 |
| Comp. 1 | 0.24 | 0.90 | 1.00 | 86.8 |
| Comp. 2 | 0.22 | 0.98 | 1.05 | 91.6 |
| Comp. 3 | 0.63 | 0.78 | 0.81 | 83.3 |
| Comp. 4 | 0.60 | 0.68 | 0.69 | 88.9 |
| Comp. 5 | 0.22 | 1.00 | 1.01 | 98.7 |

Measurement of Rate of Change in Erasure Sensitivity

The reversible thermosensitive recording medium was subjected to the measurement of reflection optical densities according to the method and the device previously described.

After an initial erasure or transparent density (ODTI) was obtained, the thermosensitive medium was immersed for 100 hours in the artificial perspiration liquid prepared as aforementioned and then dried. The resulting medium was subjected to reflection density measurements to obtain a deferred erasure density (ODTD). From the thus obtained values of ODTI and ODTD, and the value ODWI obtained in the previous recording sensitivity measurement, the rate of the change in the erasure sensitivity was calculated. The results are shown in Table 2.

TABLE 2

| Example | Initial erasure density (ODTI) | Deferred erasure density (ODTD) | Rate of change in erasure sensitivity (%) |
|---|---|---|---|
| 1 | 0.93 | 0.91 | 97.1 |
| 2 | 0.92 | 0.90 | 96.9 |
| 3 | 0.95 | 0.91 | 93.9 |
| 4 | 0.98 | 0.93 | 93.1 |
| 5 | 1.30 | 1.24 | 94.2 |
| 6 | 1.39 | 1.35 | 96.5 |
| 7 | 1.35 | 1.30 | 95.4 |
| Comp. 1 | 0.96 | 0.94 | 97.2 |
| Comp. 2 | 1.00 | 0.62 | 51.3 |
| Comp. 3 | 0.77 | 0.73 | 71.4 |
| Comp. 4 | 0.67 | 0.56 | 57.1 |
| Comp. 5 | 0.97 | 0.61 | 52.0 |

Measurement of Average Maximum Particle Size

A reversible thermosensitive recording medium was subjected to the measurement of the average maximum particle size according to the method and the device previously described.

Particle sizes of the low molecular weight organic material were obtained for one tenth of the whole particles which have largest diameters in an arbitrary area on a sliced surface of the recording medium, and the average particle diameter (S) was calculated from the sizes thus obtained. By repeating the procedure for five locations, the values of S1 through S5 were obtained. The average maximum particle size ($S_m$) was then calculated by averaging the above obtained maximum particle size values S1 through S5. The results are shown in Table 3.

TABLE 3

| Example | Average maximum particle size (micron) |
|---|---|
| 1 | 1.1 |
| 2 | 1.3 |
| 3 | 1.4 |
| 4 | 1.2 |
| 5 | 1.7 |
| 6 | 1.8 |
| 7 | 2.0 |
| Comp. 1 | 1.3 |
| Comp. 2 | 1.2 |
| Comp. 3 | 8.4 |
| Comp. 4 | 7.8 |
| Comp. 5 | 1.6 |

Measurement of Average Level Difference and Rate of Change in Level Difference.

A reversible thermosensitive recording medium was subjected to the measurement of the level difference and the rate of the change in level difference, which were caused by heat and pressure, according to the method and the device previously described.

Briefly, onto a thermosensitive recording medium heat and pressure was applied with the pressure of 2.5 kg/cm$^2$, the printing time of 10 seconds and at 130° C. using a hot stamp-type air flowing erasure testing apparatus. To obtain an initial level difference ($D_I$) and an average level difference (Dm), a two-dimensional roughness analyzing device SURFCODER AY-41, a recorder RA-60E and SURFCODER SE30K were used. After storing the medium at 50° C. for 24 hours and then cooled to room temperature, a deferred level difference ($D_D$) was obtained in a similar manner. From the values of $D_D$ and $D_I$ thus obtained, the rate of the change in level difference (Dc) was subsequently calculated. The results are shown in Table 4.

TABLE 4

| Example | Level differences and Change in level difference (%) | | |
|---|---|---|---|
| | Initial level difference ($D_I$) | Deferred level difference ($D_D$) | Change in level difference (Dc) |
| 1 | 19 | 17 | 10.5 |
| 2 | 17 | 15 | 11.8 |
| 3 | 18 | 16 | 11.1 |
| 4 | 16 | 14 | 12.5 |
| 5 | 27 | 23 | 14.8 |
| 6 | 25 | 21 | 16.0 |
| 7 | 26 | 24 | 7.7 |
| Comp. 1 | 18 | 15 | 16.7 |
| Comp. 2 | 17 | 15 | 11.8 |
| Comp. 3 | 29 | 21 | 27.6 |
| Comp. 4 | 28 | 23 | 17.9 |
| Comp. 5 | 29 | 24 | 17.2 |

As will be apparent from the above description including the examples, the reversible thermosensitive recording medium of the present invention has improved recording and erasing characteristics which is capable of maintaining initial recording media properties, thereby preserving the image contrast and display quality even after a prolonged storage of the thermosensitive recording media.

What is claimed is:

1. A reversible thermosensitive recording medium, comprising a supporting substrate and a reversible thermosensitive recording layer disposed on at least a part of said supporting substrate which comprises: a matrix resin and a low molecular weight organic material dispersed in said matrix resin, wherein said reversible thermosensitive recording layer turns a first color at a first temperature and a second color at a second temperature higher than the first temperature, and remains at the second color after cooling, wherein the reversible thermosensitive recording medium has a rate of change in recording sensitivity of 50% or less and in erasure sensitivity of 80% or more and has an average maximum particle size of 2.5 microns or less, wherein said low molecular weight organic material is a mixture of at least one low melting point, low molecular weight organic compound with at least one high melting point, low molecular weight organic compound, and neither type of organic compound has a carboxyl group therein.

2. The reversible thermosensitive recording medium of claim 1, wherein the melting point of said low melting point, low molecular weight organic compound is between about 40° and about 100° C., and the melting point of said high melting point, low molecular weight organic compound is between about 1000 and about 200° C.

3. The reversible thermosensitive recording medium of claim 1, wherein the difference in melting points between the low melting point, low molecular weight and the high melting point, low molecular weight organic compounds is at least 20° C.

4. The reversible thermosensitive recording medium of claim 3, wherein the melting point of said low melting point, low molecular weight organic material is between about 40° and about 100° C., and the melting point of said high melting point, low molecular weight organic material is between about 1000 and about 200° C.

* * * * *